United States Patent [19]

Erickson

[11] Patent Number: 4,536,046

[45] Date of Patent: Aug. 20, 1985

[54] PULL OUT FUSIBLE SWITCHES

[75] Inventor: John W. Erickson, Crystal Lake, Ill.

[73] Assignee: Boltswitch, Inc., Crystal Lake, Ill.

[21] Appl. No.: 594,905

[22] Filed: Mar. 29, 1984

[51] Int. Cl.[3] ..... H01R 13/68

[52] U.S. Cl. ..... 339/31 M; 337/194; 337/198; 337/201; 337/268; 339/147 R; 339/263 L

[58] Field of Search ..... 339/31 R, 31 B, 31 M, 339/147 R, 147 P, 252 F, 253 F, 256 C, 258 F, 259 F, 262 F, 263 L, 265 F; 337/194, 197, 198, 201, 216, 260, 262, 268, 269

[56] References Cited

U.S. PATENT DOCUMENTS

| | | | |
|---|---|---|---|
| Re. 22,266 | 2/1943 | Adam et al. | 337/194 |
| 2,193,201 | 3/1940 | Millermaster | 337/194 |
| 2,617,847 | 11/1952 | Cole | 339/252 F |
| 3,289,150 | 11/1966 | Sturdivan | 339/31 B |
| 3,599,174 | 8/1971 | Dhaliwal | 339/31 R |
| 3,996,546 | 12/1976 | Hugly | 339/31 R |

*Primary Examiner*—John McQuade
*Attorney, Agent, or Firm*—Kinzer, Plyer, Dorn & McEachran

[57] ABSTRACT

Assembly systems for compact N-pole fusible pull out switches of different ratings use the same two part insulator bases and the same insulator pull out heads in all switches. In one system, for switches of a given current rating but two different voltage ratings, there are two types of fixed contacts in the base but the contacts are the same for both voltage ratings; the fuseholder/stab contact members in the head are all the same for both switch ratings, and all mounting hardware and incidental hardware is the same for all switches. The voltage ratings are differentiated from each other only by different base terminals and by different insulator barriers over the base contacts. In another system covering six switch ratings (three different current ratings and two different voltage ratings) the two part insulator bases, the insulator heads, and the base terminals are all the same and all mounting hardware and incidental hardware is the same for all rating combinations; the six different voltage/current ratings are differentiated from each other only by different fixed contacts in the base, by different fuseholder/stab members in the head, and by different insulator barriers. The second system has only three set of fixed contacts each used for two different rating combinations. Both systems preclude misassembly and misapplication in the field. A particularly compact fuseholder/stab construction is provided for high current ratings.

33 Claims, 31 Drawing Figures

240V TERMINAL

600V TERMINAL

Fig. 16.
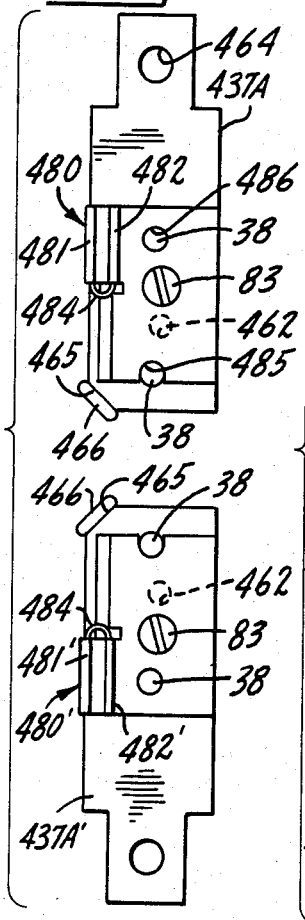
Fig. 18.
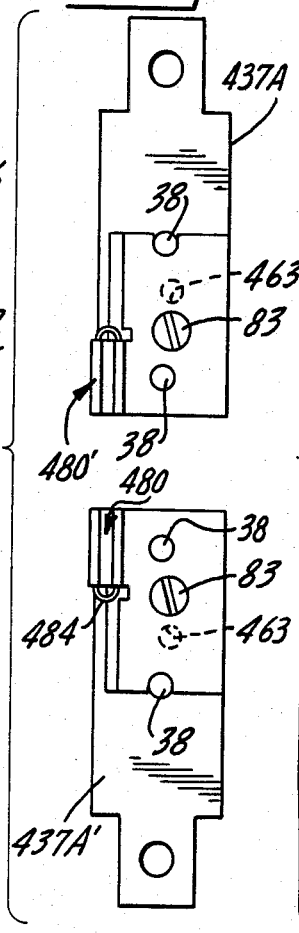
Fig. 20.
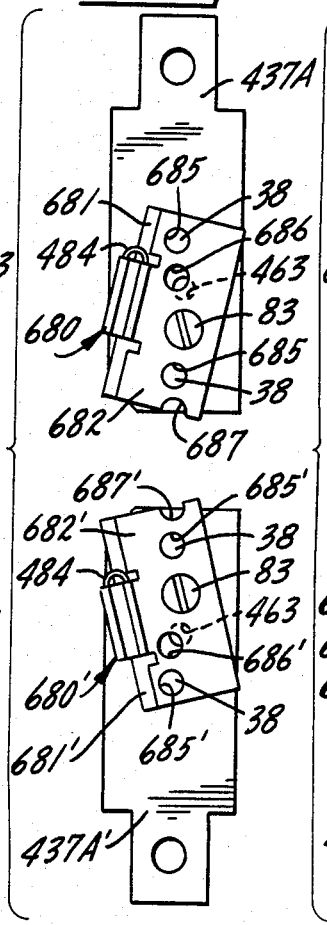
Fig. 22.
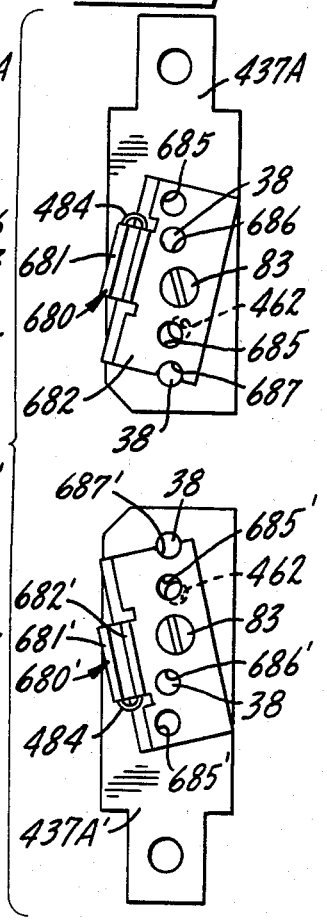
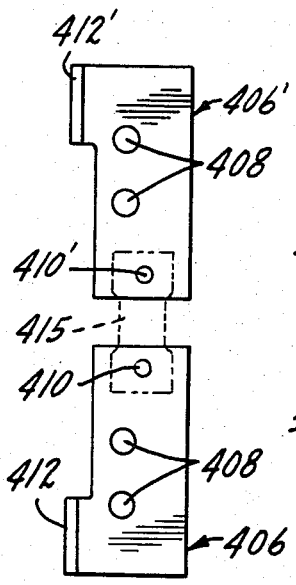
Fig. 17.
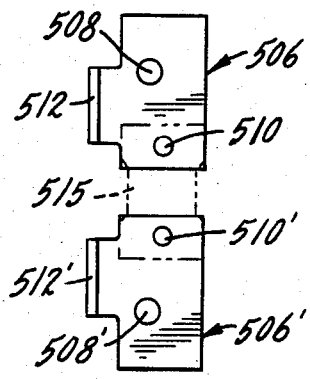
Fig. 19.
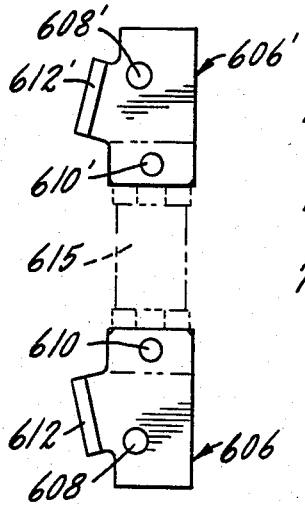
Fig. 21.
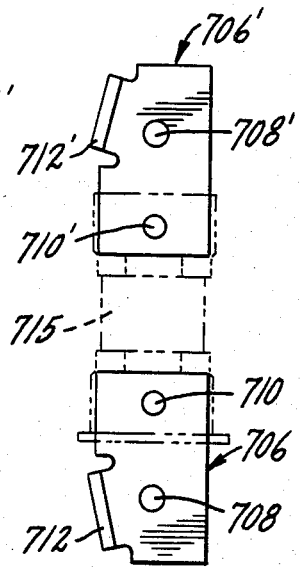
Fig. 23.

Fig. 24.
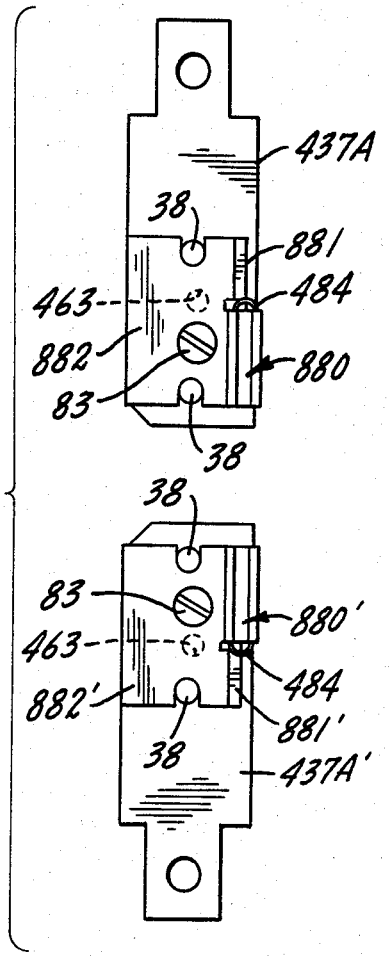
Fig. 26.
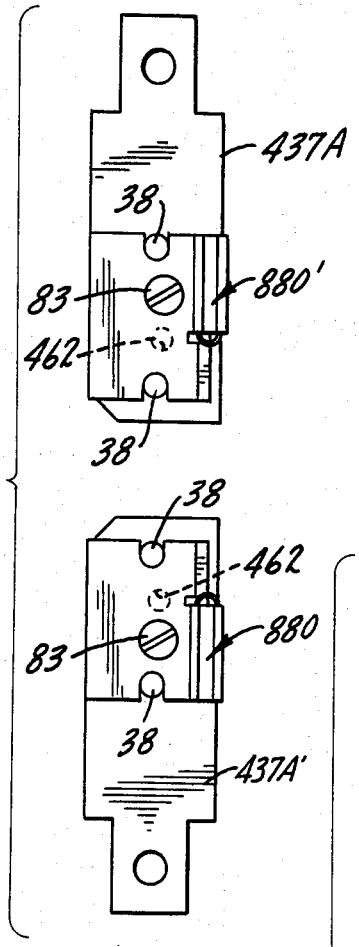
Fig. 28.
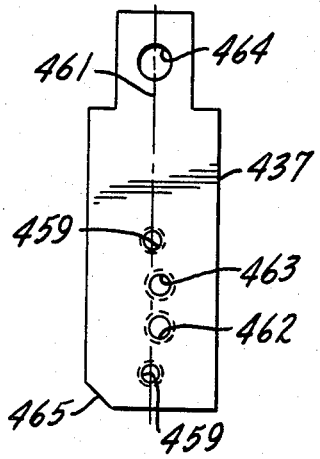
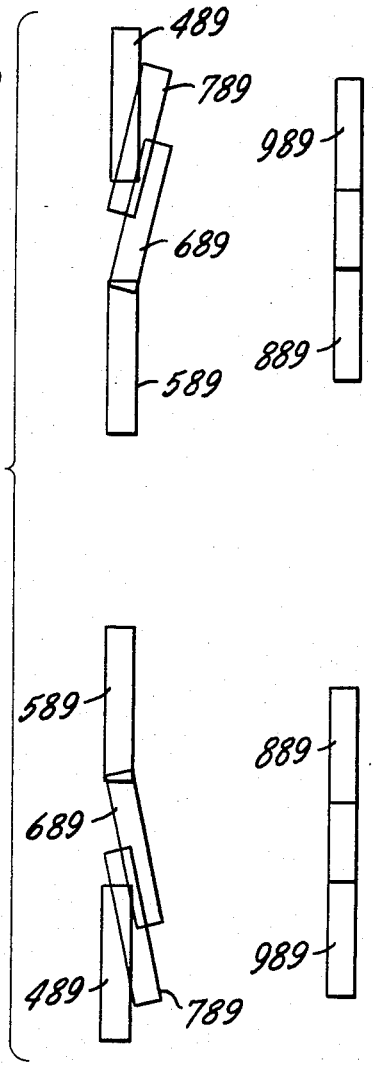
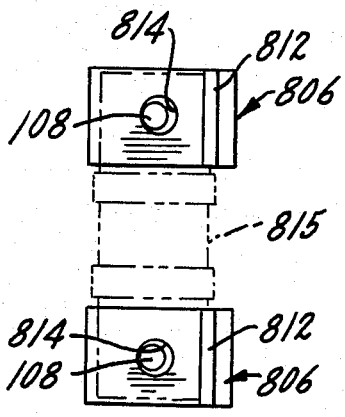
Fig. 25.
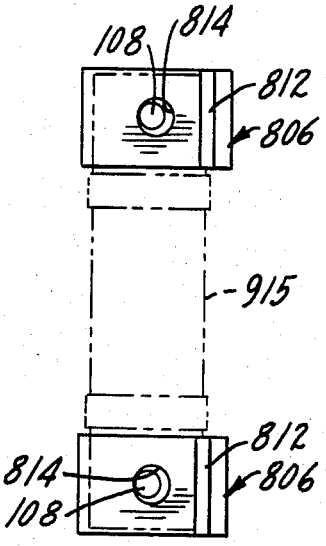
Fig. 27.
Fig. 29.

PULL OUT FUSIBLE SWITCHES

BACKGROUND OF THE INVENTION

In many applications, in office buildings, multiple residential buildings, small industrial complexes, and others, fusible switches and circuit breakers are directly competitive. In this competitive situation, fusible switches have the advantage of lower cost in comparison with circuit breakers. On the other hand, a circuit breaker usually affords a more positive indication of operation in response to an overload and also is more compact in size. Due to the size differential, fusible switches and circuit breakers have not been truly interchangeable; that is, for most applications it has not been possible to make a direct substitution of fusible switches for circuit breakers or vice versa.

Common service entrance voltage ratings are 240 volts and 600 volts. Depending upon the circuit served, the current rating for a fusible switch or circuit breaker may be 30 amperes, 60 amperes, 100 amperes, or 200 amperes. Considering all of these possible voltage/current ratings, the cost of components for individualized fusible switches, using different components for each switch rating, can be a critical factor in the competitive equation.

The cost of fusible switches usable over a broad range of voltage and current ratings could be materially reduced by use of essentially identical, interchangeable component parts in switches having substantially different ratings. In this way, tooling and manufacturing costs can be materially reduced. But the use of identical parts for switches of different ratings creates a substantial danger of mistakes in assembly of the switches or in installation and use of those switches. Thus, if a 600 volt fusible switch, as assembled, permits installation of 240 volt fuses, a dangerous situation may be created, even though the incorrect fuse has the correct current rating. Similarly, if a 240 volt fusible switch of the pull out type allows insertion of a 600 volt head or if a 100 ampere switch head can be inserted into a 60 ampere or 30 ampere switch base, an obviously dangerous condition may be created. Consequently, standardization of individual components for use in fusible switches of different voltage and current ratings has been relatively limited.

SUMMARY OF THE INVENTION

It is a principal object of the present invention, therefore, to provide a new and improved assembly system and construction for plural-pole fusible pull out switches having different voltage and current ratings.

Another object of the invention is to provide a new and improved assembly system and construction for plural-pole fusible pullout switches that enables those switches to be matched in size to circuit breakers of the same voltage and current ratings so that direct interchangeability is achieved.

An additional object of the invention is to provide a new and improved assembly system and construction for plural-pole fusible pull out switches that utilizes a maximum number of essentially identical interchangeable parts for different switch ratings yet affords comprehensive protection against mistakes in assembly or in installation.

A further object of the invention is to provide a new and improved fuseholder/stab member construction for use as a movable contact and fuse mount in a fusible pull out switch, a construction that is extremely compact yet inexpensive to manufacture and convenient and reliable in use.

Another object of the invention is to provide a new and improved assembly system for plural-pole fusible pull out switches that are simple and economical in construction yet rugged and enduring in operation.

Accordingly, in one aspect the invention relates to an assembly system for N-pole fusible pull out switches of M different voltage/current switch ratings, comprising a plurality of essentially identical insulator bases each including N line terminal mounts aligned one for one with N load terminal mounts, with the line terminal mounts at one end of the base and the load terminal mounts at the opposite end of the base, a multiplicity of conductive terminals each mountable on any terminal mount in the base, and a multiplicity of conductive base contacts each mountable on a terminal in M sets of different line and load contact positions, one set for each switch rating. The system further comprises a multiplicity of insulator barrier means of M types, each barrier means comprising a cover for a base, the barrier means of each type having 2N spaced connect apertures individually aligned with the line and load contact positions for one of the switch ratings and 2N similarly spaced disconnect apertures displaced from its connect apertures, a plurality of essentially identical insulator base extensions each mountable on a base over a barrier means and defining a head receptacle, a plurality of essentially identical insulator heads each including 2N fuseholder/stab mounts, each head being insertable into a base extension head receptacle in a connect orientation or in a disconnect orientation displaced 180° from the connect orientation, and a multiplicity of conductive fuseholder/stab members, each fuseholder/stab member including a stab engageable with a base contact to complete a circuit connection, including fuseholder/-stab members mountable on the mounts of a head in M different alignments each corresponding to the connect-/disconnect aperture alignments of one type of barrier means, each barrier means blocking insertion of any head into a head receptacle in either orientation, unless the alignment of the fuseholder/stab members in the head corresponds to the aperture alignment of that barrier means.

In another aspect the invention relates to an N-pole fusible pull out switch, comprising an insulator base including N line terminal mounts aligned one for one with N load terminal mounts, with the line terminal mounts at one end of the base and the load terminal mounts at the opposite end of the base, 2N essentially identical conductive terminals each mounted on a terminal mount in the base, N conductive line contacts each mounted on a line terminal, and N conductive load contacts each mounted on a load terminal, the load contacts constituting flopovers of the line contacts. The switch further comprises insulator barrier means mounted on and comprising a cover for the base, the barrier means having 2N spaced connect apertures individually aligned with the line and load contacts and 2N similarly spaced disconnect apertures displaced from the connect apertures, an insulator base extension mounted on the base over the barrier means and defining a head receptacle, an insulator, including 2N fuseholder/stab mounts, insertable into the base extension head receptacle in a connect orientation or in a disconnect orientation displaced 180° from the connect orientation, and 2N conductive fuseholder/stab members, each including a stab for engaging a line or load contact to complete a circuit connection, each fuseholder/stab member mounted on one of the mounts in the head in an alignment corresponding to one pair of connect and disconnect apertures in the barrier means.

In a further aspect, the invention relates to a fuseholder/stab member for mounting one end of a fuse in a fusible switch, the fuse including a cylindrical fuse body of radius R and two coplanar flat fuse terminals of length L and width W projecting axially from opposite ends of the fuse body; the fuseholder/stab member includes a continuous conductive metal strap comprising, in sequence, a mounting base portion having a length less than 2R, a U bend portion of substantial radius with an included angle of the order of 20°, a flat fuse-mount portion having a length of about W and having a height over the base portion, at the center of the fuse-mount portion, of about R, and an external stab portion extending away from the fuse-mount portion in a direction approximately perpendicular to the base portion.

BRIEF DESCRIPTION OF THE DRAWINGS

FIG. 16 is a simplified illustration of the base terminals and contacts for a 30 ampere 240 volt switch constructed with components from an assembly system constituting another embodiment of the invention;

FIG. 17 is a simplified illustration of the fuseholder/stab members and their mounting in the head of a switch for the base construction shown in FIG. 16;

FIGS. 18 and 19 are views corresponding to FIGS. 16 and 17, respectively, for a 60 ampere 240 volt switch;

FIGS. 20 and 21 are views corresponding to FIGS. 16 and 17, respectively, for a 30 ampere 600 volt switch;

FIGS. 22 and 23 are views corresponding to FIGS. 16 and 17, respectively, for a 60 ampere 600 volt switch;

FIGS. 24 and 25 are views corresponding to FIGS. 16 and 17, respectively, for a 100 ampere 240 volt switch;

FIGS. 26 and 27 are views corresponding to FIGS. 16 and 17, respectively, for a 100 ampere 600 volt switch;

FIG. 28 is a plan view of a switch terminal used in all of the switches of FIGS. 16–27; and FIG. 29 is a schematic illustration of the insulator barrier connect apertures for all of the switches of FIGS. 16–27.

DETAILED DESCRIPTION OF THE PREFERRED EMBODIMENTS

Figure 1:
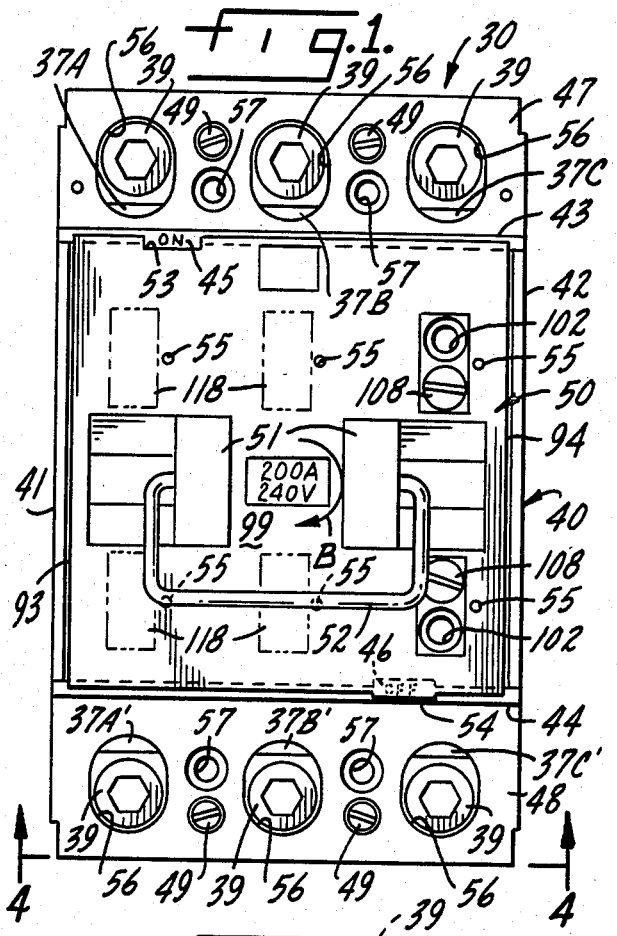
FIG. 1 is a front elevation view of a 200 ampere 240 volt fusible pull out switch constructed from the components of an assembly system according to one embodiment of the present invention.
Figure 2:
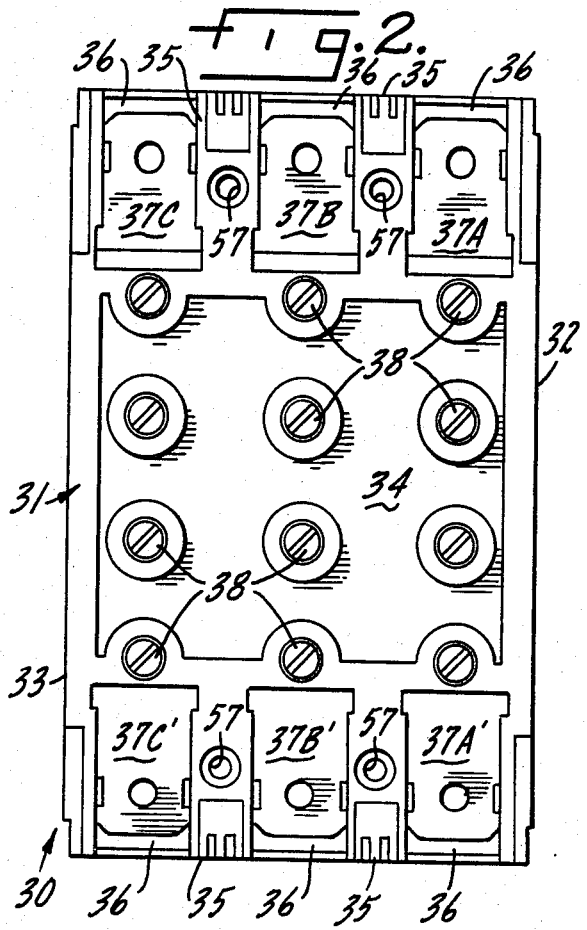
FIG. 2 is a rear elevation view of the switch of FIG. 1.

FIGS. 1–4 are external views of a three pole fusible pull out switch 30 constructed from components of an assembly system constituting one embodiment of the present invention. Switch 30 has a rating of 200 amperes and 240 volts. The system used for assembly of switch 30 is also applicable to switches of different ratings as described in connection with FIGS. 11–14.

Switch 30 includes a base 31 having side walls 32 and 33 and a rear wall 34. At each end of base 31 there are two relatively thick divider walls 35 (see FIGS. 2 and 4), dividing each end of the base into three terminal/connector enclosures 36. Base 31 is formed of insulator material and preferably is molded of an insulator resin, usually a phenolic resin.

The fusible pull out switch 30 of FIGS. 1–4 includes three line terminals 37A, 37B, and 37C located at the top of the switch and three load terminals 37A', 37B' and 37C' located at the bottom of the switch. All of the terminals are essentially identical to and interchangeable with each other, and each terminal fits through one of the terminal/connector enclosures 36 into the interior of base 31. In the interior of the base 31, each terminal is supported upon the rear wall 34 of base 31; see FIG. 3. Each terminal is secured in a fixed position in base 31 by a pair of terminal mounting screws 38, FIG. 2. A series of terminal connectors 39 for completing electrical connections to external line and load conductors (not shown) are mounted upon the outer ends of the terminals, each connector 39 being located within one of the enclosures 36.

Figure 3:
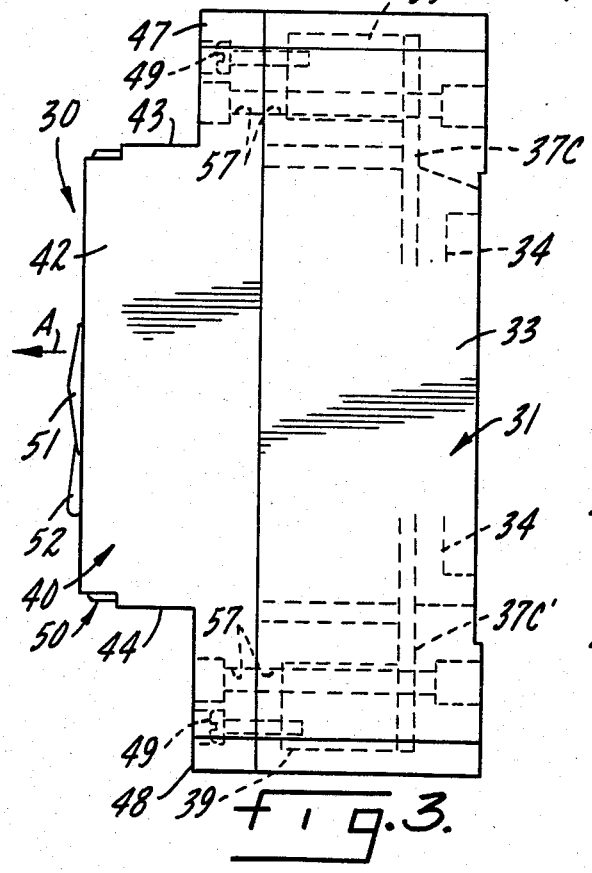
FIG. 3 is a side elevation view of the switch of FIG. 1.

Switch 30 further comprises an insulator base extension 40 mounted on and projecting outwardly of base 31. Base extension 40 includes two side walls 41 and 42, an upper wall 43, and a lower wall 44, defining a head receptacle. An ON indicator 45 is formed in a thickened portion of the wall 43 as shown in FIG. 1. An OFF indicator 46 is formed in a similar thickened portion of the lower wall 44. A part of base extension 40 projects beyond upper wall 43 to afford a line terminal cover 47 at the top of the switch. At the bottom of the switch, a similar integral part of base extension 40 projects beyond wall 44 to provide a load terminal cover 48. Base extension 40 is mounted on base 31 by four mounting screws 49 as shown in FIGS. 1 and 3.

Switch 30 further comprises an insulator pull out head 50 which fits into the receptacle afforded by base extension 40 and which, like base 31 and base extension 40, is preferably of molded phenolic resin. Head 50 includes a pair of externally projecting lugs 51 in which a handle 52 is mounted. In the orientation for head 50 shown in FIG. 1, the upper edge of the head affords a recess 53 that exposes the ON indicator 45. Head 50 includes a complementary projection 54 which, in the orientation shown in FIG. 1, covers the OFF indication 46. There are six test holes 55 extending inwardly of head 50 from its front surface.

When installed, switch 30 is usually positioned in a panelboard, facing outwardly as shown in FIG. 1. Line connections are made to terminals 37A–37C, using the connectors 39 for those terminals. In completing these connections, access to the terminal connectors 39 is afforded through three terminal connector access openings 56 in the terminal cover 47. Similarly, load connections are made to terminals 37A′–37C′ by means of the connectors 39 for those terminals, with access provided by openings 56 in the terminal cover 48. Mounting of switch 30 is provided by a plurality of mounting holes 57 that extend through the terminal cover portions 47 and 48 of base extension 40 and through the end dividers 35 that are a part of base 31 (see FIGS. 1–3).

The general operation of pull out switch 30 can be described from FIGS. 1–4. Base 31 contains two sets of switch contacts, three line contacts electrically connected to terminals 37A–37C and three load contacts connected to terminals 37A′–37C′. Head 50, on the other hand, incorporates an equal number of pairs of fuseholder/stab contact members engageable with the contacts in base 31. Thus, there are three fuseholder/-stab members for the line side of head 50 and three for the load side of the head. Each load fuseholder/stab member is connected by an appropriate fuse to the fuseholder/stab member on the line side. In this instance, because switch 30 has a rating of 200 amperes and 240 volts, fuses of this rating would be employed.

With head 50 in the orientation illustrated in FIG. 1, switch 30 is in its connected or closed condition. Visual inspection of the switch reveals that it is closed because the ON indicator 45 is exposed to view through the recess 53 in head 50 and the OFF indicator 46 is covered by projection 54.

Figure 4:
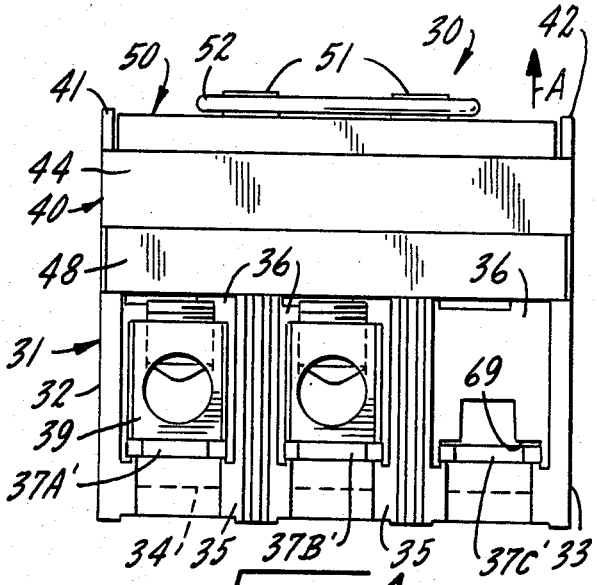
FIG. 4 is an end view of the switch taken approximately as indicated by line 4—4 in FIG. 1.

To open switch 30, head 50 is pulled outwardly of the switch base 31,40 as indicated by arrow A in FIGS. 3 and 4, removing the head from the switch and effectively opening all internal circuits. If it is desired to leave switch 30 in an open or OFF position for any period of time, head 50 may be rotated 180° as indicated by arrow B in FIG. 1 and reinserted into the receptacle afforded by base extension 40. This rotational displacement of the switch head leaves all of the internal stab contacts in the head displaced from the contacts in base 31 so that the switch remains OFF. With this orientation of head 50, recess 53 exposes the OFF indicator 46 to view and projection 54 covers the ON indicator 45. This allows for continued storage of head 50 in switch 30 with the switch open. It also affords a convenient storage arrangement for head 50 in the switch base 31,40 for shipping purposes.

Figure 5:
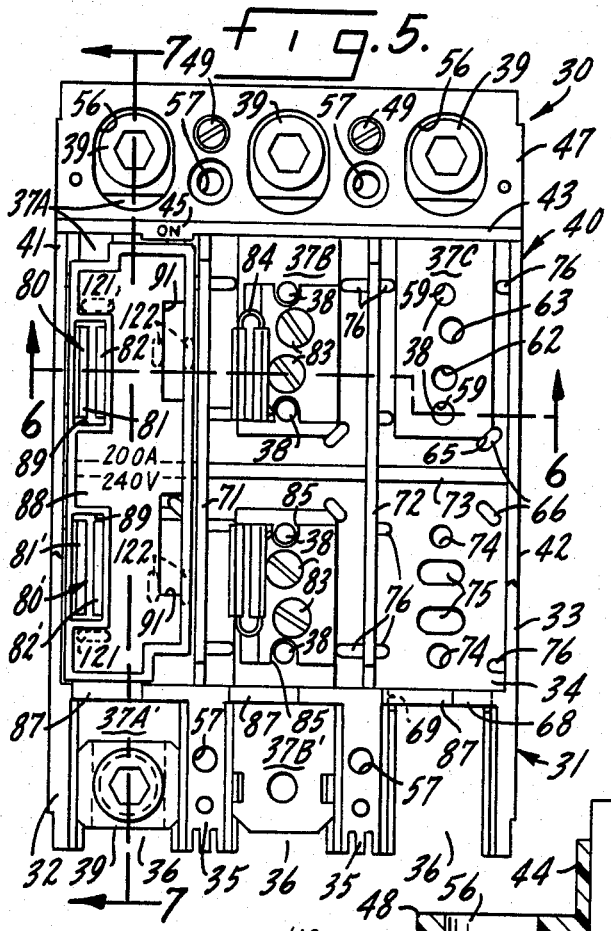
FIG. 5 is a front elevation view of the base of the switch of FIG. 1 with some of the components removed and a part of the base cut away to illustrate underlying components.
Figure 6:
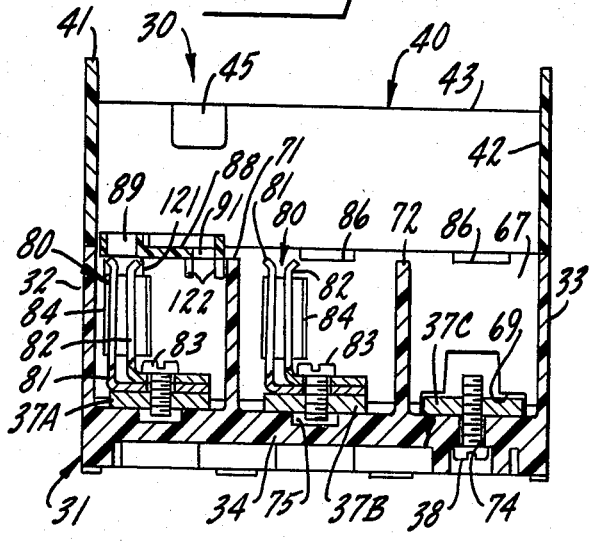
FIG. 6 is a transverse sectional view taken approximately as indicated by line 6—6 in FIG. 5.
Figure 7:
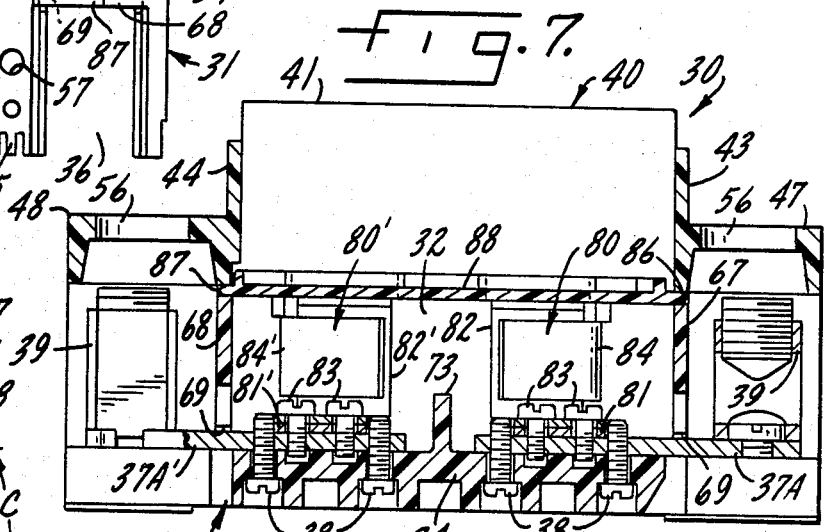
FIG. 7 is a longitudinal sectional view taken approximately as indicated by line 7—7 in FIG. 5.
Figure 13A:
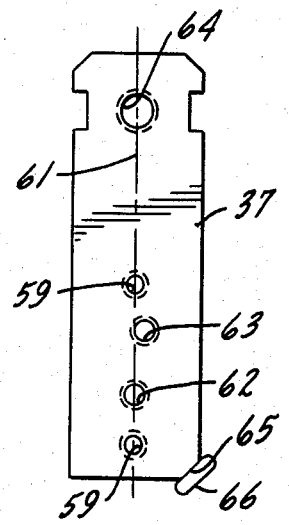
FIG. 13A is a plan view of a terminal for the switch of FIGS. 1–10.

The mounting and positioning of conductive components of switch 30 within base 31 are best illustrated in FIGS. 5–7, taken in conjunction with FIG. 13A which illustrates one of the terminals 37. All of the terminals 37A–37C and 37A′–37C′ utilize the same essentially identical and interchangeable construction as shown for the terminal 37 in FIG. 13A. As shown therein, each terminal 37 has two tapped terminal mounting holes 59 aligned along the centerline 61 of the terminal. Between the terminal mounting holes 59 there are two spaced tapped contact mounting holes 62 and 63. One contact mounting hole 62 is on centerline 61, but hole 63 is displaced a short distance from the centerline. An additional tapped hole 64 is provided at the outer end of terminal 37 and is used to mount a connector 39 on the terminal. One internal corner 65 of each terminal 37 is cut off or bevelled, as illustrated in FIG. 13A, to control orientation of the terminal within base 31 by engagement with a projection 66 that is a part of the base as described below.

Returning to FIGS. 5–7, it is seen that base 31 includes an upper end wall 67 and a lower end wall 68. As best shown in FIG. 7, the upper base end wall 67 is aligned with the base extension wall 43 whereas the lower base end wall 68 is aligned with the base extension wall 44. The base walls 67 and 68 are each provided with a series of apertures 69 through which terminals 37 can be inserted into the interior of base 31.

In the central portion of base 31 there are two spaced longitudinal walls 71 and 72 and a transverse wall 73. Referring to FIG. 5, it is seen that walls 71–73 divide the interior of base 31 into six open-top terminal mount compartments, one for each of the line terminals 37A–37C and load terminals 37A′–37C′. Each terminal is shown mounted in place in its interior compartment in FIG. 5 with the exception of load terminal 37C′, which has been omitted from the view to display its terminal mount.

The terminal mount in the lower right-hand portion of FIG. 5 that is to receive terminal 37C′ includes two holes 74, aligned approximately along the center line of the terminal compartment, to accommodate two terminal mounting screws 38. The terminal mounting holes 74 extend completely through the rear wall 34 of base 31. Between the two holes 74 there are two shallow depressions 75. The mounting lug 66 is in the upper right-hand corner of the terminal mounting compartment and additional alignment lugs 76 project inwardly of the compartment from base walls 33 and 72. Lugs 66 and 76 can be replaced by a continuous ledge if desired.

To mount one of the terminals 37 (FIG. 13A) in the compartment for terminal 37C′ in base 31 (FIG. 5), the terminal is turned over end-for-end from the position shown in FIG. 13A and inserted through the slot 69 in wall 68 until the bevel corner 65 on the terminal engages lug 66. Two of the terminal mounting screws 38 are then inserted through holes 74 in the rear wall 34 of base 31 and engaged in the tapped holes 59 in the terminal, securely fastening the terminal in the base. The result is illustrated by terminal 37C as shown in FIGS. 5 and 6. Each of the two terminal mounting screws 38 projects well above the surface of the terminal to provide two location or alignment posts for a contact to be mounted on the terminal. From the foregoing description and from the illustration of terminal 37C in FIG. 5, it can be seen that each terminal mount in base 31, comprising lugs 66 and 76 in conjunction with mounting screws 38, accurately positions a terminal within the base.

In the next step in assembly of switch 30, three conductive clip contacts 80 are mounted in base 31, one clip contact on each of the line terminals 37A–37C. Each contact 80 includes two L-shaped contact elements 81 and 82 that are mounted upon one of the terminals 37A–37C by a pair of contact mounting screws 83 that extend through aligned holes in the contact elements and threaded into the tapped holes 62 and 63 in the terminal. A spring clip 84 is mounted upon contact elements 81 and 82 to complete contact 80; spring 84 is used to provide firm contact engagment with a stab contact inserted between the contact elements 81 and 82 as described below. Each of the contact elements is provided with a pair of recesses 85 that engage the terminal mounting screws 38. Thus, the terminal mounting screws 38 serve as alignment posts for the clip contacts 80.

There are also three load clip contacts 80' mounted in base 31 (two shown in FIG. 5). Each clip contact 80' includes two L-shaped contact elements 81' and 82' that are "flopovers" of elements 81 and 82. As before, the contact elements are mounted on a load terminal (37A'–37C') by mounting screws 83 and are engaged by a spring clip 84. The clip contacts 80 and 80' for terminals 37B and 37B' are shown mounted in place, ready for use, in the central terminal compartments of base 31 in FIG. 5.

The upper end wall 67 of base 31 includes three barrier mounting slots 86, one for each line terminal 37A–37C; two of the barrier mounting slots 86 appear in FIG. 6. Similarly, there are a series of three barrier mounting slots 87 in the lower end wall 68 of base 31 as shown in FIG. 5. Slots 86 and 87 are not aligned directly opposite each other; each slot 86 is offset to the right of the centerline of the terminal with which it is associated whereas each slot 87 is offset to the left of the associated terminal. These slots 86 and 87 are utilized to mount an insulator barrier means covering base 31. In the illustrated construction, this barrier means comprises three individual insulator barriers 88; only one of the barriers 88 is shown in FIGS. 5–7.

Each insulator barrier 88 has two spaced connect slots or apertures 89. When a barrier 88 is mounted on base 31 slots 89 are aligned with the contacts 80, 80' for one pair of line and load terminals, such as the terminals 37A and 37A'. Slots 89 are referred to as "connect slots" because they provide access to contacts 80 and 80'. Each insulator barrier 88 is also provided with two disconnect slots 91 that are aligned with each other and that have the same spacing as slots 89 but that are displaced from connect slots. The disconnect slots 91 do not provide access to any of the base contacts. It can thus be seen that when all three insulator barriers 88 are mounted in base 31, in mounting slots 86 and 87, they afford a complete insulator barrier means across the open portion of base 31 and are held in position on the base by base extension 40; see FIG. 7.

Figure 10:
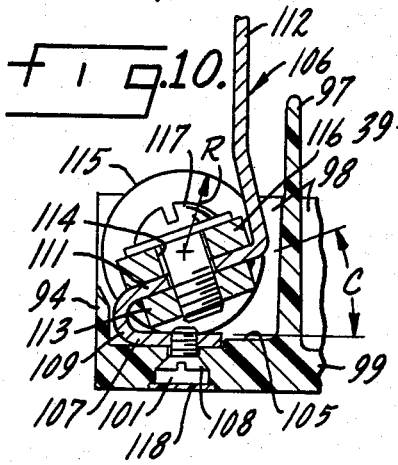
FIG. 10 is a detail sectional view taken approximately as indicated by line 10—10 in FIG. 8.
Figure 9:
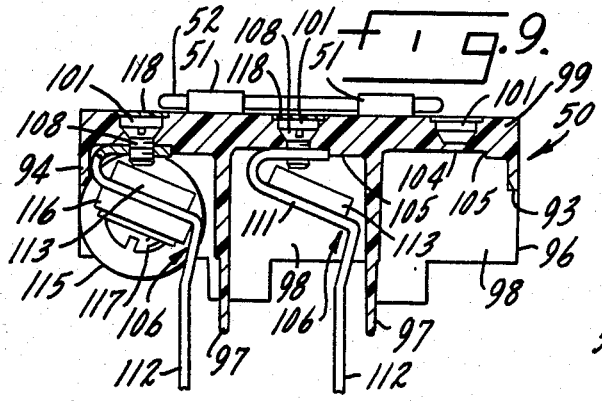
FIG. 9 is a transverse sectional view taken approximately as indicated by line 9—9 in FIG. 8.
Figure 8:
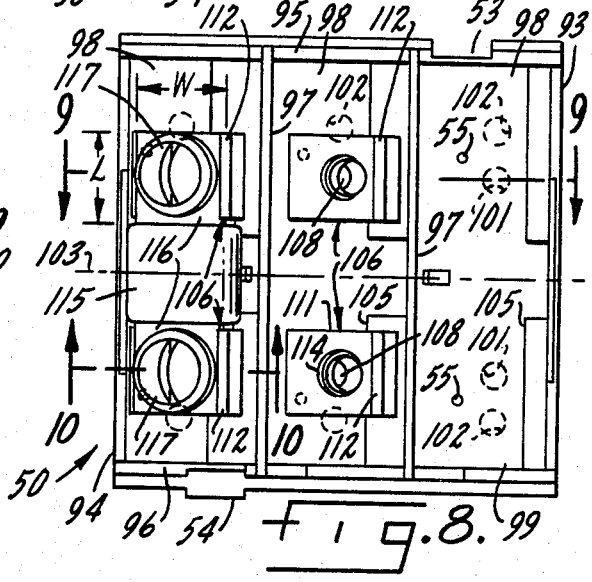
FIG. 8 is a rear elevation view of the pull-out head of the switch of FIG. 1, with some components removed.

The mounting and location of conductive elements within head 50 as employed in switch 30 is best shown in FIGS. 8 through 10. As shown therein, the insulator head 50 includes two relatively short side walls 93 and 94; walls 93 and 94 fit between base extension walls 41 and 42 as shown in FIG. 1. The head also includes two end walls 95 and 96 (FIG. 8) that fit between base extension walls 43 and 44 (FIG. 1). Two longitudinal internal walls 97 divide the interior of head 50 into three fuse compartments 98 as shown in FIGS. 8 and 9.

As shown in FIG. 8, the recess 53 employed to reveal the ON designation 45 or the OFF designation 46 is formed in end wall 95 of head 50. Conversely, the projection 54 that is employed to cover-the ON and OFF indicators, depending upon the orientation of head 50 in the switch base, is formed as a part of end wall 96.

The front or outer wall 99 of head 50 is relatively thick. When head 50 is molded, six fuseholder mounting holes 101 are formed in wall 99. Another set of six fuseholder mounting holes 102 are also molded into head wall 99 in paired relation with holes 101. Holes 102 are farther from the transverse center line 103 of head 50 than holes 101; see FIG. 8. As molded, the fuseholder mounting holes 101 and 102 are not complete; rather, each hole is closed on its inner surface by a membrane 104 as shown for hole 101 in FIG. 9. In assembling the switch head the membranes 104 of the fuseholder mounting holes 101 or 102 that are to be used are punched out to receive fuseholder mounting screws 108 as shown in FIG. 9. In the system of FIGS. 1–15 the mounting holes 101 are used for low voltage (240 volt) switches. Holes 102, on the other hand, are used for high voltage switches as explained hereinafter.

Two fuseholder/stab members 106 are mounted in each of the compartments 98 in head 50 as shown in FIGS. 8 and 9. The construction of one fuseholder/stab member is best shown in FIG. 10. Each member 106 includes a continuous conductive metal strap comprising a mounting base portion 107 that lies flat against the inner surface of wall 99 and is guided in alignment by a ledge 105 in wall 99. Base portion 107 is secured to wall 99 by a fuseholder mounting screw 108 seated in one of the holes 101. The conductive metal strap further comprises a U-bend portion 109 with an included angle C of approximately twenty degrees. Beyond the U-bend portion 109, the strap continues with a flat fuse mount portion 111 and concludes with an external stab portion 112, the outer end of which projects approximately perpendicular to the base portion 107 of the strap. A fuse mounting nut 113 is welded or otherwise secured to the lower surface of the fuse mount portion 111 of the conductive strap in alignment with a centrally located hole 114 in portion 111.

The fuses 115 used in switch 30 are conventional type T fuses each including a cylindrical fuse body having a radius R. This type of fuse has two flat coplanar terminals each having a length L and a width W (FIG. 8). As can be seen from FIG. 10, the length of the mounting base portion 107 of the fuseholder/stab member 106 is less than twice the fuse radius R. The overall length of the fuse mount portion 111 is approximately equal to the fuse terminal width W and the height of the fuse mount portion 111 over the base portion 107, at the center of the fuse mount portion 111, is approximately equal to the fuse radius R. Each fuse 115 is mounted between two of the fuseholder stab members 106 by means of two fuse mounting screws 117 that extend through central apertures in the fuse terminals 116 and are threaded into the nuts 113; see FIGS. 8–10. An insulator cover 118 is installed in the outer surface of wall 99 of head 50 after each fuseholder/stab member 106 is mounted in the switch head, covering screw 108; see FIGS. 1, 9 and 10.

The unique configuration for the combination fuseholder/stab members 106 is of appreciable importance in achieving a fusible switch construction compact enough to match the size of a conventional circuit breaker of the same current and voltage rating. As readily seen from FIG. 10, the overall width of each fuseholder 106 is approximately the same as the maximum width (2R) of the fuse itself. The overall distance between the outer edges of a pair of fuseholders used to mount one fuse 115 in switch head 50 (see FIG. 8) is no longer than the total length of the fuse itself over the ends of its terminals 116. The complete fuse mounting provided by two of these fuseholders 106 affords the shortest possible current path through the fuse. Nevertheless, a reasonable surface area is available for heat dissipation. The acute angle C between the base portion 107 and the fuse mount portion 111 of the fuseholder makes it convenient to change fuses, using a common screwdriver, and allows for rotation of the fuse for ease of installation or removal.

By turning head 50 over from right to left from the rear view of FIG. 9, it is seen that the stab elements 112 can be brought into alignment with the connect slots 89 through the barriers 88 in the switch base, FIG. 5. Of course, this also aligns each stab 112 with one of the clip contacts 80, 80' in the switch base. Inserting switch head 50 into base extension 40 and base 31 with this "connect" orientation, completes a fused circuit from each line terminal 37A–37C through one of the fuses 115 to the related load terminal 37A'–37C'. In this manner, the switch is closed to its ON condition, the operational condition illustrated in FIGS. 1–4.

On the other hand, if switch head 50 is rotated 180° about centerline 103 from the position shown in FIG. 8, each stab element 112 ends up aligned with one of the barrier disconnect slots 91, FIG. 5. By inserting the switch head with this "disconnect" orientation, each stab 112 enters base 31 out of alignment and out of engagement with any of the base contacts 80 or 80'. The head can be stored in this position, with all circuits disconnected, either for shipment or for the completion of work on a given circuit or like purposes.

Figure 11:
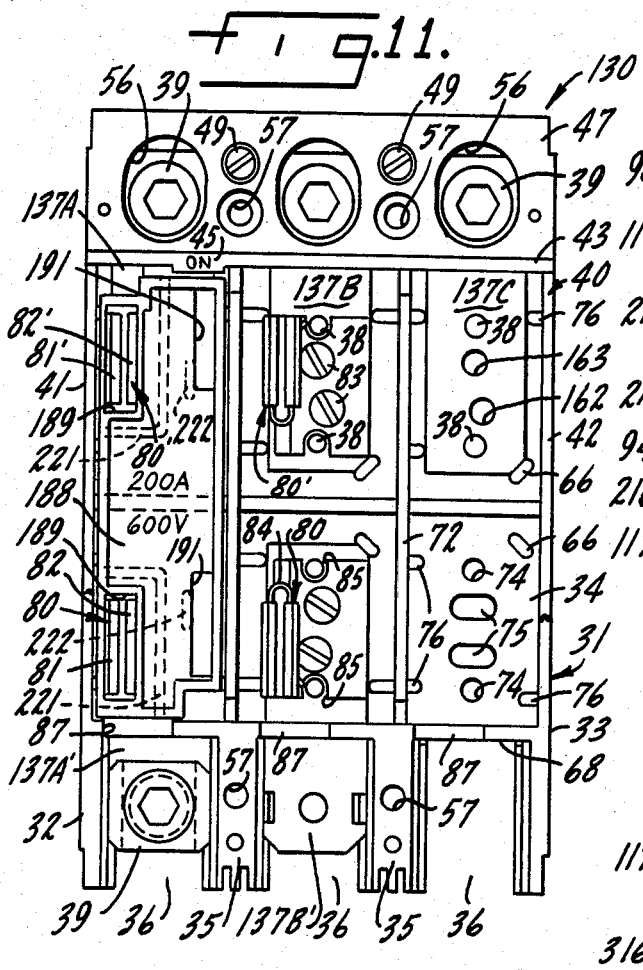
FIG. 11 is a front elevation view of a switch base like FIG. 5 except that the base shown is for a 200 ampere 600 volt switch assembled from components from the same system.
Figure 12:
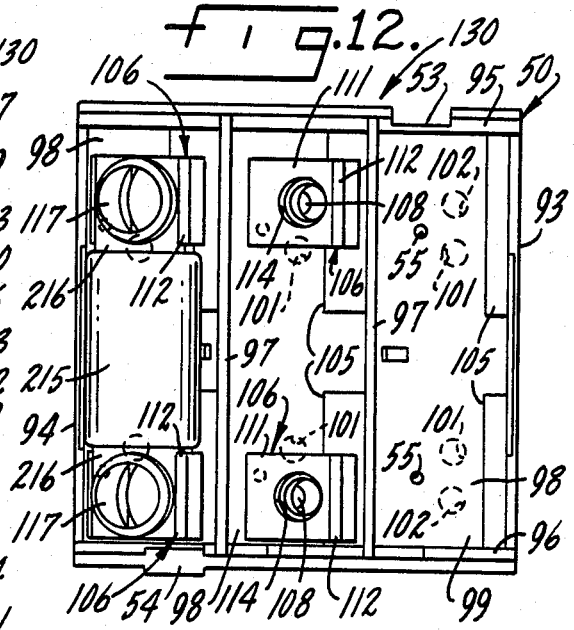
FIG. 12 is a rear view of the head for the switch shown in FIG. 11, with some components removed, like FIG. 8.

The fusible 200 A/240 V pull out switch 30 that is illustrated in FIGS. 1–10 and described above is assembled from a system of components that can also be utilized, in substantial part, in the assembly of fusible pull-out switches of different ratings. Thus, the 200 ampere 600 volt switch 130 illustrated in FIGS. 11 and 12 (FIG. 11 corresponds to FIG. 5 and FIG. 12 corresponds to FIG. 8) is produced from the same assembly system and uses most of the same parts as switch 30. In FIGS. 11 and 12, component parts of switch 130 that remain unchanged from those employed in switch 30 have the same reference numerals.

The insulator base 31 utilized in switch 130, FIG. 11, is the same as and is interchangeable with base 31 of switch 30 and thus includes the same line terminal mounts, load terminal mounts, and other structural features. Switch 130 includes three line terminals 137A, 137B, and 137C and three corresponding load terminals, represented in FIG. 11 by terminals 137A' and 137B'. As in the case of FIG. 5, the third load terminal has been omitted from the drawing; it fits into the enclosure 36 at the lower right-hand corner of FIG. 11.

Figure 13B:
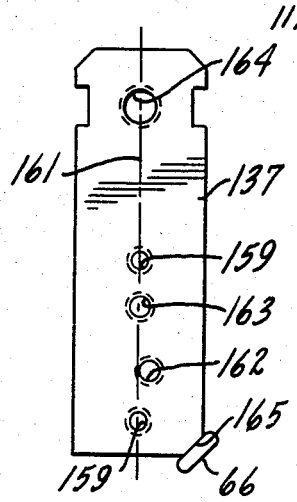
FIG. 13B is a plan view of a terminal for the switch of FIGS. 11 and 12.
Figure 15A:
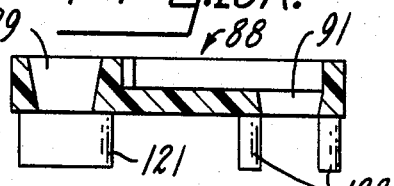
FIG. 15A is a detail sectional view, on an enlarged scale, of an insulator barrier used in the low voltage switch, taken approximately along line 6—6 in FIG. 5.
Figure 15B:
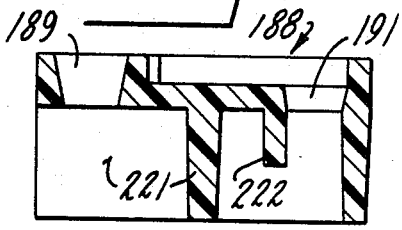
FIG. 15B is a detail sectional view of a barrier used in the high voltage switch, otherwise corresponding to FIG. 15A.

The line and load terminals for switch 130 all have the same construction illustrated by terminal 137 in FIG. 13B. Each terminal 137 is formed of a thick conductive strap and has two tapped terminal mounting holes 159 aligned along its center line 161. The spacing between holes 159 is the same as for the terminal mounting holes 59 in terminal 37 (FIG. 13A) so that terminal 137 can be mounted in base 31 (FIG. 11) in exactly the same manner as previously described.

In terminal 137, FIG. 13B, there are two tapped contact mounting holes 162 and 163 that are spaced from each other and that are located between holes 159. The spacing between contact mounting holes 162 and 163 is the same as for holes 62 and 63 for terminal 37, FIG. 13A. However, in this instance hole 163 is located on centerline 161 whereas hole 162 is displaced a short distance from the center line. Thus, the significant difference between terminals 37 and 137 is the arrangement of the contact mounting holes 162 and 163. In all other respects, the two terminals are essentially the same; terminal 137 has a tapped hole 164 for mounting a connector 39 on the terminal and has a bevelled corner 165 to engage one of the projections 66 in base 31 (FIG. 11). Terminal 137 may be made slightly shorter than terminal 37 to preclude mounting of the 600 volt switch 130 in a panelboard intended to accommodate only a 240 volt switch such as switch 30; all this does is to position the connectors 39 slightly farther inwardly in enclosures 36.

The mounting arrangement for one of the terminals in switch 130 is best illustrated by terminal 137C in FIG. 11. Each terminal is again mounted in base 31 by two terminal mounting screws 38. As before, the terminal mounting screws 38 project well above the surface of terminal 137C to provide contact alignment posts. The base of switch 130 uses the same clip contacts 80 and 80' as in switch 30. In the high voltage switch 130, however, the locations of the two types of clip contacts are reversed. Thus, the contacts 80, each incorporating a contact element 81, a contact element 82 and a spring clip 84, are mounted in the base of switch 130 in the load contact positions rather than the line contact positions. The other clip contacts 80' are employed as line contacts mounted upon terminals 137A–137C. As before, mounting of each contact is effected by two mounting screws 83. The result, in switch 130, is paired sets of line and load clip contacts, in an alignment essentially the same as in switch 30 except that the spacing between each line contact 80' and its associated load contact 80 is substantially larger than in the low voltage switch.

The base of the high voltage switch 130, FIG. 11, also incorporates barrier means covering base 31. The barrier means comprises three individual insulator barriers 188, with only one of the barriers being illustrated. Each insulator barrier 188 has two spaced connect apertures 189 and two similarly spaced disconnect apertures 191. Barrier 188 is mounted in the same slots in the base walls, such as the slots 87 (FIG. 11), as were used for barriers 88 in the low voltage switch (see FIG. 5). The connect slots 189 are aligned over and provide access to the clip contacts 80 and 80'. The disconnect slots 191 are displaced from the clip contacts and do not allow for completion of any electrical circuits.

Head 50, as utilized in the high voltage switch 130, shows even less change from the low voltage switch 30. As shown in FIG. 12, the same fuseholder/stab members 106 are mounted in insulator head 50 as in the previously described switch. The only change is that members 106 are installed in the insulator head by means of mounting screws 108 inserted through the mounting screw holes 102 instead of apertures 101 in the front wall 99 of the head. This effectively positions the fuseholder/stab members 106 in insulator head 50 with a spacing sufficient to accommodate a long 600 volt fuse 215 (FIG. 12) instead of a short 240 volt fuse 115 (FIG. 8). As before, fuse 215 has two flat terminals 216 secured to the fuseholder/stab members 106 by appropriate screws 117. Stabs 112 end up aligned with the connect apertures 189 in barriers 188 when the switch head is inserted in the switch base in its connect orientation.

Figure 14:
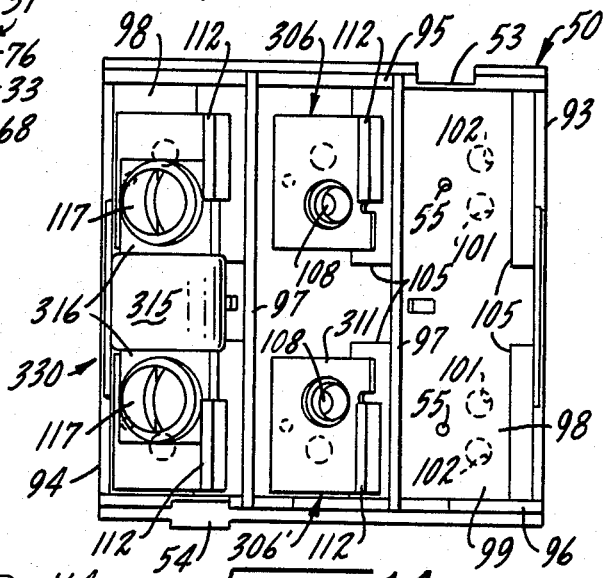
FIG. 14 is a rear view of a switch head, like FIGS. 8 and 12, but showing the head adapted for use at a voltage rating of 480Y/277 V.

One other modification that can be adopted to provide a third switch rating while still using most of the components common to the switches 30 and 130 described above is illustrated by the switch head 330 for a switch rated at 200 amperes and 480Y/277 volts, shown in FIG. 14.

In this instance, the only change made in the pull-out head for the switch is in the fuseholder/stab members. Each member 306 has the same construction as described above in connection with the fuseholder/stab member 106 of FIGS. 8–10 except that it is formed from a wider strap so that, although member 306 is mounted in head 50 by a mounting screw 108 extending through one of the low voltage mounting apertures 101, the stab 112 ends up in the high voltage position. A similar arrangement is used for the other set of fuseholder/stab members 306'. As will be apparent, the two sets of fuseholder/stab 306, 306' members cannot be identical in this instance because of the additional spacing required for the stabs 112.

As shown in FIG. 5, each barrier 88 employed in the low voltage switch 30 has the switch rating of 200 A,240 V molded into the barrier. Similarly, each insulator barrier 188 employed in the high voltage switch 130 has the switch rating of 200 A,600 V molded into the barrier as shown in FIG. 11. The current/voltage rating for switch 330 would similarly be molded into its barriers. To preclude careless misassembly of the barriers in switches having the wrong ratings, however, it is desirable to provide each barrier with one or more interference elements that positively prevent assembly of a low voltage switch with high voltage barriers and vice versa.

For the low voltage barrier 88, FIG. 5, this interference arrangement includes two lugs 121 that are molded integrally with barrier 88 and project rearwardly immediately adjacent the connect apertures 89. Adjacent each disconnect aperture 91 there are two rearwardly projecting interference lugs 122. These interference lugs 121 and 122 can also be seen in FIG. 15A, an enlarged sectional illustration of barrier 88 taken approximately along line 6—6 in FIG. 5. There are similar interference elements on the high voltage barriers 188, comprising the elements 221 and 222 that appear in FIGS. 11 and 15B.

If an attempt is made to mount one of the low voltage barriers 88 on a base for a high voltage switch 130, the interference lugs 121 on the barrier engage the clip contacts 80 and 80' (see FIG. 11) and the barrier cannot be seated in the mounting slots in base 31. Similarly, if an attempt is made to mount one of the high voltage barriers 188 on a base 31 for a low voltage switch 30, the interference elements 221 engage the contacts 80 and 81 in that base and will not allow the barrier to be seated in the mounting slots. Thus, the interference elements on the individual barriers prevent misassembly; a complete switch can be assembled only with a barrier means that matches the switch rating. The barriers for a 480Y/277 volt switch can employ the same interference elements as the 600 V barriers 188; here, use of higher rated fuses is not a problem.

It may also be desirable to have the overall thickness of one barrier different from the other so that an assembler gets a different "feel" in assembling switches of different voltage ratings. Thus, the high voltage insulator barrier 188 may be made substantially thicker than the low voltage barrier 88 (compare FIGS. 15B and 15A) so that the person assembling a switch need not read the switch rating, instead being able to distinguish between the two different barriers simply by "feel".

For the switches of FIGS. 1–15, involving three different switch ratings, many of the components are essentially identical in construction and interchangeable with each other. Thus, the principal structural insulator components, constituting the bases 31, the base extensions 40, and the insulator heads 50, are all the same for all three switch ratings. The same clip contacts 80 and 80' are used in all of the switches, although their positions are different in the high voltage and low voltage bases. The fuseholder/stab members are the same for the 240 volt and 600 volt versions of the switch, but different for the 480Y/277 volt switch. All of the terminals used for the low voltage switches are the same, but they are different from the terminals that are used in all high voltage switches. In all of the switches, all of the mounting hardware and the terminal connectors are the same regardless of the switch rating. Of course, as described above, the barrier means for each switch rating is different from the other switch ratings.

A multi-rating switch assembly system as described for switches 30, 130, and 330 offers substantial advantages. Because most of the components are the same and are interchangeable, appreciable economies of manufacture are realized. The particular fuseholder/stab member construction employed in these switches minimizes the overall size required for mounting conventional fuses in the switches and makes it possible to manufacture compact fusible switches that are directly interchangeable with circuit breakers of the same ratings. That is, one of the fusible switches constructed with this assembly system can be substituted in an existing panelboard directly in place of a circuit breaker.

On the other hand, it is difficult if not impossible to assemble one of the fusible switches incorrectly. The terminals of the switches cannot be installed in the bases improperly, due to the bevelled corner on each terminal that requires that the terminal be inserted in the base in its correct alignment. Once the terminals are installed in a base, the clip contacts cannot be installed in the wrong positions because the mounting holes in the contact members will not line up with the mounting holes in a terminal. The barriers must be installed in the correct orientation in each base because they are keyed to the asymmetrical mounting slots in that base. On the other hand, the interference elements on each barrier member make it impossible to assemble a switch with barriers for the wrong switch rating. When assembled, the pull out head for a low voltage switch will not fit into a high voltage base; conversely, the head for a high voltage switch cannot be inserted into a base for a low voltage switch. This applies to both the connect and disconnect orientations for the switch heads; the insulator barriers block insertion of the wrong head into a switch base in both the connect and disconnect orientations.

The two-piece construction employed for each switch base, including a main base 31 and base extension 40, provides for improved ease of switch assembly because the conductive parts being assembled in the base 31 are more accessible than if a conventional one-piece construction were employed. The two-piece construction for the base also facilitates assembly of the barriers (88 and 188) in close proximity to the contacts in the switch base. Bases 31 and base extensions 40 are provided with key interlock elements (not shown) that are asymmetrical to make certain that each base extension 40 is installed on a base 31 with the indicators 45 and 46 (FIG. 1) in the proper locations. When a base extension 40 is mounted on a base 31, the recessed mounting screws 49 (FIGS. 1 and 3) can be covered with a potting compound to seal the base extension to the base and preclude any tampering that would involve removal of the base extension from the base.

FIGS. 16 through 29 illustrate a switch assembly system, comprising another embodiment of the invention, in which many common components are utilized in the assembly of fusible pull-out switches having six different switch ratings. More specifically, the six switch ratings constitute all of the possible combinations of 30,60, and 100 amperes and 240 and 600 volts. For this system, the structural insulator parts constituting the base, the base extension, and the head of the switch have not been illustrated. It is assumed that these structural insulation parts are the same as base 31, base extension 40, and head 50 as described above with but minor variations. To distinguish this system from the 200 ampere system of FIGS. 1–15, some changes in the structural insulator components may be desirable. For example, the position of the angled terminal location element 66 for each terminal in base 31 may be changed from the right-hand side of each terminal compartment (FIGS. 5 and 11) the left-hand side to reduce the possibility of assembly of one of the terminals for the low current system in a base intended for use in the high current system. On the other hand, modifications of this kind are not essential and it is not imperative to change the principal structural insulator members-in any way.

In the switch assembly system of FIGS. 16–29, all of the terminals have the same construction and all are interchangeable with each other. The terminal construction is shown in FIG. 28. As illustrated therein, terminal 437, again formed of flat copper or other conductive strap, has two tapped terminal mounting holes 459 employed to mount the terminal in an insulator base such as the previously described base 31. The terminal mounting holes 459 are aligned on the centerline 461 of the terminal. Between the terminal mounting holes 459 there are two tapped contact mounting holes 462 and 463 which are offset a small distance to one side of the centerline 461. A tapped connector mounting hole 464 is provided at one end of terminal 437. One corner 465 of the terminal is bevelled or cut off to provide for effective orientation of the terminal in the base, as in the previously described system.

FIG. 16 illustrates the manner in which a line terminal 437A and a load terminal 437A′ are mounted in a switch base 31 for a 30 ampere 240 volt switch. As before, the two terminals are oppositely oriented with respect to each other, with orientation being determined by engagement of the bevelled corner 465 with a base projection 466 in each instance. As before, each of the load and line terminals is mounted in the base by means of two terminal mounting screws 38 which project well above the surface of the terminal to provide mounting and guide posts for a contact to be mounted on the terminal.

The clip contact 480 mounted on line terminal 437A in FIG. 16 is similar in construction to the previously described clip terminal 80. It includes two L-shaped contact elements 481 and 482. Each of these contact elements has a slot 485 that engages one of-the guide posts afforded by a terminal mounting screw 38. Each of the contact elements 481 and 482 also includes an aperture 486 that fits over the other terminal mounting screw and guide post 38. Contact 480 is secured to line terminal 437A by a single mounting screw 83 threaded into the contact mounting hole 463 (see FIG. 28) in the terminal. The other contact mounting hole 462 in terminal 437A is not used. A spring clip 484, like the previously described spring clip 84, completes contact 480.

The clip contact 480′ mounted on load terminal 437A′ in FIG. 16 is a vertical flopover of contact 480. It includes contact elements 481′ and 482′ secured to terminal 437A′ by one contact mounting screw 83. As in the case of the line terminal 473A, the contact mounting hole 462 in load terminal 437A′ is not used.

FIG. 17 illustrates the basic construction and mounting for fuseholder/stab members in the switch head for the 30 ampere 240 volt base contact arrangement of FIG. 16. The line-side fuseholder/stab member 406 is mounted in the insulator head of the switch by two mounting screws 408, utilizing both of the mounting holes 101 and 102 in the head (see FIG. 8). A tapped mounting hole 410 is provided to mount a fuse retainer clip (not shown) on member 406. An integral projecting stab 412 is provided to mate with clip contact 480 (FIG. 16). The load side fuseholder/stab member 406′ of FIG. 17 is a vertical flopover of member 406 and includes a tapped fuse clip mounting hole 410′ and a projecting stab contact 412′ to engage line contact 480′. Again, member 406′ is mounted in the head by two mounting screws 408. A 30 ampere 240 volt fuse may be mounted between members 406 and 406′, utilizing conventional spring fuseholder clips (not shown) mounted on members 406 and 406′; as indicated by phantom outline 415.

FIG. 18 shows the terminal and contact arrangement for a 60 ampere 240 volt switch that uses the same components as employed in FIG. 16. The contacts 437A and 437A′ are mounted in the base in the same manner as in FIG. 16. In this instance, a clip contact 480 is utilized as the load contact, being mounted on load terminal 437A′, whereas a contact 480′ is employed as the line contact mounted upon terminal 437A. The mounting screws 83 in this instance engage in the contact mounting holes 462 of the terminal (see FIG. 28) and the other contact mounting holes 463 are not used. The result is a contact alignment similar to that of FIG. 16 except that the spacing between contacts 480 and 480′ is substantially different.

FIG. 19 shows two fuseholder/stab members 506 and 506′ mounted in a switch insulator head for use with the base contact arrangement shown in FIG. 18. The fuseholder/stab member 506 is mounted in the head by means of a single mounting screw 508, employing the mounting hole 101 in the head (FIG. 8). A tapped hole 510 in member 506 is provided for mounting a fuse retention clip (not shown). The stab 512 of member 506 is located, in the head, in a position to engage contact 480, FIG. 18, when the head is inserted into the switch base in the connect orientation.

The other fuseholder/stab member 506′ shown in FIG. 19 is a vertical flopover of member 506 and includes a spring retainer clip mounting hole 510′ and a stab 512′. The single mounting screw 508′ positions member 506′ so that stab 512′ can engage in clip contact 480′ in the position of FIG. 18. The phantom outline 515 shows the position of the 60 ampere 240 volt fuse for this switch arrangement.

FIG. 20 illustrates the base terminal and contact construction and orientation for a 30 ampere 600 volt switch. The line side clip contact 680 mounted on terminal 437A in FIG. 20 includes two L-shaped contact elements 681 and 682 with the usual spring clip 484 around the projecting contact legs. Two holes 685 through each of the contact elements 681 and 682 engage the terminal mounting screw alignment posts 38. Contact 680 is mounted on terminal 437A, in FIG. 20, by a single contact mounting screw 83 threaded into the mounting hole 462 in the terminal (see FIG. 28); the other contact mounting hole 463 in terminal 437A is not used in FIG. 20.

The load side clip contact 680' mounted on load terminal 437A' in FIG. 20 is a vertical flopover of the line side contact 680. It includes two contact elements 681' and 682' mounted on terminal 437A' by a single mounting screw 83. The two alignment posts 38 are again engaged in contact element apertures 685'.

FIG. 21 shows a fuseholder/stab construction and mounting arrangement to be used with the terminal and contact assembly shown in FIG. 20. The line side fuseholder/stab member 606 is mounted in a switch head by a single mounting screw 608 that utilizes the head mounting hole 102 (FIG. 8). A tapped mounting hole 610 for a fuse retainer clip (not shown) is included in member 606, which has a vertically projecting stab 612 aligned to engage in contact 680 (FIG. 20) when the switch is closed.

The load side fuseholder/stab member 606' illustrated in FIG. 21 is a vertical flopover of member 606. It is mounted in a switch insulator head by a single screw 608' and includes a tapped fuse retainer mounting hole 610' and a vertically projecting stab 612' that mates with contact 680' (FIG. 20). The phantom outline 615 (FIG. 21) shows the position of a 30 ampere 600 volt fuse as employed in the switch construction of FIGS. 20 and 21.

FIGS. 22 and 23 show the construction and arrangement for a 60 ampere 600 volt switch that uses the same hardware as the 30 ampere switch of FIGS. 20 and 21. In this instance the clip contact 680 is mounted on terminal 437A as the line side contact with one of the terminal mounting screw alignment posts 38 engaged in aligned apertures 686 in the two contact elements 681 and 682 and the other post 38 engaged in an alignment slot 687 in each contact element. In this instance, the holes 685 in the contact elements are not used. As before, a single contact mounting screw 83 secures contact 680 to terminal 437A; in this instance, screw 83 is screwed into contact mounting hole 463 in terminal 437A (see FIG. 28) and hole 462 is not used.

For the 60 ampere 600 volt arrangement of FIG. 22, clip contact 680' is mounted on load terminal 437A', again by means of a single mounting screw 83. The mounting arrangement is complementary to that for contact 680.

FIG. 23 shows the fuseholder/stab members 706 and 706' that are mounted in a switch head for use with the base contact arrangement illustrated in FIG. 22. Member 706 is mounted in a switch head by a single screw 708 through one of the mounting holes 102 (FIG. 8) in the head. It includes a tapped hole 710 for mounting a fuse retainer (not shown) and a vertically extending stab 712 aligned to fit into a clip contact 680 in the alignment shown in FIG. 22. The other fuseholder/stab member 706' is a vertical flopover of member 706, mounted in the head by means of a single screw 708' and including a tapped fuse clip mounting hole 710' and a vertically extending stab 712'. The position of a 60 ampere 600 volt fuse is shown in FIG. 23 by phantom outline 715.

FIGS. 24 and 25 illustrate the conductive hardware arrangements used for a 100 ampere 240 volt switch in the system of FIGS. 16–29. As shown in FIG. 24, the line side clip contact 880 mounted on terminal 437A comprises two L-shaped contact elements 881 and 882 with a spring clip 484. Slots in the two contact elements engage the terminal mounting screw alignment posts 38. The two contact elements are mounted on terminal 437A by one mounting screw 83 engaged in the mounting hole 462 (see FIG. 28) in the terminal with the other contact mounting hole 463 unused. The other clip contact 880' mounted on terminal 437A' is a vertical flopover of contact 880 and includes two contact elements 881' and 882' secured by one screw 83 with edge slots engaging both of the alignment posts 38. In this switch, unlike those previously described, the upwardly extending portions of the contact elements are positioned at the right-hand side of the terminals 437A and 437A'.

The fuseholder/stab members 806 employed in the construction illustrated in FIG. 25, for use with the contacts 880 and 880' of FIG. 24, may correspond in all respects to the fuseholder/stab members 106 used in the switches of FIGS. 1–15 except that the stabs 812 are located on the right-hand side instead of the left-hand side in each instance. Members 806 are each mounted in an insulator head by means of a single mounting screw 108 extending through one of the mounting apertures 101 (FIG. 8) in the head and each has a fuse terminal mounting aperture 814. The stabs 812 of these members 806 line up with and are insertable into the contacts 880 and 880' (FIG. 24). The position of a 100 ampere 240 volt fuse mounted in the head is indicated by phantom outline 815 in FIG. 25.

FIGS. 26 and 27 illustrate the conductive hardware mounting arrangements for a 100 ampere 600 volt switch that uses the same hardware as the 240 volt switch of FIGS. 24 and 25. In this instance, the clip contact 880' is mounted on the line side terminal 437A and the clip contact 880 is mounted on the load side terminal 437A'. For this mounting, the contact mounting holes 462 in the terminals cannot be used; the mounting screws 83 must be engaged in the terminal mounting holes 463 (FIG. 28). The mounting for the hardware in the head, comprising fuseholder/stab members 806 as shown in FIG. 27, is the same as in FIG. 25 except that the outer head mounting holes 102 (FIG. 8) are used to get the greater spacing required to align the stabs 812 with the contact positions shown in FIG. 26. The phantom outline 915 shows the position of a fuse in this 100 ampere 600 volt switch arrangement.

Throughout the preceding specification, it is assumed that Type T fuses are employed in the fusible switches assembled with the systems of the invention. It is not essential that such fuses be employed, however. Type R fuses can be utilized, where suited to the switch ratings, by incorporating appropriate fuse retainers in the switch heads in place of those suited to Type T fuses.

In all of the switches for the system illustrated in FIGS. 16–28, barrier means should be provided over the switch base, corresponding to the barriers 88 and 188 described in connection with the system of FIGS. 1–15. Preferably, each barrier means incorporates an individual barrier member for each pole of the switch, as in the first system. The barrier means must provide a full set of connect slots or apertures affording access to all of the clip contacts in the switch base and a similar set of disconnect slots at the opposite side of the barrier to permit insertion of the switch head in a disconnect orientation as described in connection with the first system.

FIG. 29 illustrates the pattern of connect slots for the complete system of switches of FIGS. 16–27. The connect slot positions 489 correspond to the 30 ampere 240 volt switch of FIGS. 16 and 17 and the similarly aligned but differently spaced connect slot positions 589 are those for the 60 ampere 240 volt switch of FIGS. 18 and 19. The angled connect slot positions 689 in FIG. 29 are those required for the 30 ampere 600 volt switch of FIGS. 20 and 21 whereas the similarly angled but differently spaced connect slot positions 789 of FIG. 29 correspond to the contact positions for the 60 ampere 600 volt switch of FIGS. 22 and 23. Finally, the connect slot positions 889 of FIG. 29 fit the contacts for the 100 ampere 240 volt switch arrangement of FIGS. 24 and 25 whereas the similarly aligned but differently spaced connect slot positions 989 in FIG. 29 correspond to the 100 ampere 600 volt switch construction of FIGS. 26 and 27.

The pattern of connect aperture positions shown in FIG. 29 adequately defines the requirements for the barrier means needed for each switch in the assembly system of FIGS. 16–28, including the necessary disconnect apertures. In all instances the insulator barrier should include appropriate interference elements to preclude misassembly.

In the switch assembly system depicted in FIGS. 16–29, all of the structural insulator members, constituting the bases, the base extensions, and the insulator heads, are essentially identical and interchangeable. The terminals used in all of the switches, both for line side and load side connections, are the same, and the terminals are always mounted in the switch base in the same orientations. Each set of clip contacts is used in two different switch ratings. For the 30 ampere and 60 ampere switches (FIGS. 16–23), the fuseholder/stab members are different for each switch, but for the 100 ampere switches (FIGS. 24–27) the fuseholder/stab members are the same for both voltage ratings. Of course, a distinctively different set of insulator barriers is required for each of the six different switch ratings; see FIG. 29. As in the first system, all of the incidental hardware elements, such as screws 38, 83, etc., are the same.

Each of the switch assembly systems described above provides for the manufacture of M different fusible pull out switches each having N poles. For the system of FIGS. 1–15, $M=3$; for the system of FIGS. 16–29 $M \geqq 6$. For both systems, as described, $N=3$, but the same systematic arrangements can be applied to two pole and four pole switches. In each system all of the principal structural insulator components, constituting the base, the base extension, and the insulator head are essentially identical and interchangeable. Indeed, these principal insulator components could be used in a unified system covering all of the voltage/current rating combinations for both of the described systems. In any of the systems there are some conductive parts that are common to all switch ratings; moreover differences between conductive components that cannot be used in all switches are minimized by frequent pairing for two different ratings. All in all, the systems of the invention provide for maximization of the number of switch ratings encompassed by a minimum number of different component parts.

I claim:

1. An assembly system for N-pole fusible pull out switches of M different voltage/current switch ratings comprising:

a plurality of essentially identical insulator bases each including N line terminal mounts aligned one for one with N load terminal mounts, with the line terminal mounts at one end of the base and the load terminal mounts at the opposite end of the base;

a multiplicity of conductive terminals each mountable on any terminal mount in the base;

a multiplicity of conductive base contacts each mountable on a terminal in M sets of different line and load contact positions, one set for each switch rating;

a multiplicity of insulator barrier means of M types, each barrier means comprising a cover for a base, the barrier means of each type having 2N spaced connect apertures individually aligned with the line and load contact positions for one of the switch ratings and 2N similarly spaced disconnect apertures displaced from its connect apertures;

a plurality of essentially identical insulator base extensions each mountable on a base over a barrier means and defining a head receptacle;

a plurality of essentially identical insulator heads each including 2N fuseholder/stab mounts, each head being insertable into a base extension head receptacle in a connect orientation or in a disconnect orientation displaced 180° from the connect orientation;

and a multiplicity of conductive fuseholder/stab members, each fuseholder/stab member including a stab engageable with a base contact to complete a circuit connection, including fuseholder/stab members mountable on the mounts of a head in M different alignments each corresponding to the connect/disconnect aperture alignments of one type of barrier means;

each barrier means blocking insertion of any head into a head receptacle in either orientation, unless the alignment of the fuseholder/stab members in the head corresponds to the aperture alignment of that barrier means.

2. An assembly system for fusible pull out switches according to claim 1 in which each terminal comprises an elongated conductive metal strap having at least one tapped terminal mounting hole and at least one tapped contact mounting hole displaced from the terminal mounting hole, each terminal being mounted in a base by a screw extending through the base, threaded into the terminal mounting hole and projecting upwardly beyond the terminal surface as a contact alignment post, and in which each base contact is mounted on a terminal by a screw extending downwardly through a hole in the contact and threaded into a contact mounting hole in the terminal, each contact further having an alignment aperture engaging a contact alignment post.

3. An assembly system for fusible pull out switches according to claim 2 in which each terminal comprises two terminal mounting holes aligned on the center line of the terminal and is mounted in a base by two screws each affording a contact alignment post, and in which each base contact has two alignment apertures engaging the alignment posts.

4. An assembly system for fusible pull out switches according to claim 3 in which each terminal comprises two spaced contact mounting holes located intermediate the terminal mounting holes, with at least one contact mounting hole offset from the terminal centerline.

5. An assembly system for fusible pull out switches according to claim 4 in which all switches have one common rating factor, current or voltage, the system including two types of base contacts, one a flopover of the other, and in which the base contacts of each type are mountable on a line terminal or on a load terminal, thereby providing two different sets of contact positions.

6. An assembly system for fusible pull out switches according to claim 5 in which the contact mounting holes in each terminal are displaced laterally from each other, and in which each base contact is mounted on a terminal by two screws threaded into the contact mounting holes in the terminals so that the contact positions are determined by orientation of the terminals as mounted in the base.

7. An assembly system for fusible pull out switches according to claim 4, in which the terminals are essentially identical for all switch ratings, in which the contact mounting holes in each terminal are aligned along a line parallel to the terminal centerline, and in which each base contact is mounted on a terminal by only one bolt threaded into one of the contact mounting holes.

8. An assembly system for fusible pull out switches according to claim 3 in which each terminal comprises two spaced contact mounting holes, in which the terminals are essentially identical for all switch ratings, and in which positioning of the contacts in line and load positions for different switch ratings is determined in part by the orientations of the base contacts on the terminals.

9. An assembly system for fusible pull out switches according to claim 8 in which M is an integer greater than three, in which the contact mounting holes in each terminal are aligned along a line parallel to the terminal centerline, in which each base contact is mounted on a terminal by only one bolt threaded into one of the contact mounting holes, and in which the base contacts are of different configurations, with each contact usable for two different switch ratings.

10. An assembly system for fusible pull out switches according to claim 9 in which both contact mounting holes are located intermediate the terminal mounting holes and are aligned along a line parallel to but spaced from the terminal centerline, in which there are M types of base contacts forming M/2 paired sets with the contacts in each set being flopovers, each pair set being mountable on the terminals in two different positions to serve two different switch ratings.

11. An assembly system for fusible pull out switches according to claim 10, in which some of the contact positions have the contacts aligned parallel to the terminal centerline and others have the contacts angularly displaced relative to the centerline.

12. An assembly system for fusible pull out switches according to claim 1 in which each barrier means includes at least one interference element to prevent mounting on a base having base contacts in line and load positions for a different switch rating than the barrier means.

13. An assembly system for fusible pull out switches according to claim 12 in which each base includes N pairs of open-top terminal compartments with a line terminal mount and a load terminal mount in each compartment pair, and in which each barrier means comprises N essentially identical insulator barriers each adapted to cover any pair of terminal compartments, each barrier having two connect apertures and two disconnect apertures, and each barrier including at least one integral interference element.

14. An assembly system for fusible pull out switches according to claim 13 in which each barrier includes a set of at least two interference elements to prevent mounting that barrier on a base having a base contact in any line or load position for a switch rating different from the barrier.

15. An assembly system for fusible pull out switches according to claim 14 in which each barrier includes an additional set of at least two interference elements to prevent mounting the barrier in an incorrect orientation on a base having base contacts mounted in line and load positions corresponding to the switch rating for that barrier.

16. An assembly system for fusible pull out switches according to claim 14 in which there are two different voltage ratings and in which all barriers of one voltage rating are materially thicker than all barriers of the other voltage rating to permit distinguishing by feel.

17. An assembly system for fusible pull out switches according to claim 1, for use with fuses of the kind including a cylindrical fuse body of radius R and two coplanar flat fuse terminals of length L and width W projecting axially from opposite ends of the fuse body, in which each fuseholder/stab member includes a continuous conductive metal strap comprising, in sequence:

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

18. An assembly system for fusible pull out switches according to claim 6, for use with fuses of the kind including a cylindrical fuse body of radius R and two coplanar flat fuse terminals of length L and width W projecting axially from opposite ends of the fuse body, in which each fuseholder/stab member includes a continuous conductive metal strap comprising, in sequence:

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

19. An assembly system for fusible pull out switches according to claim 7, for use with fuses of the kind including a cylindrical fuse body of radius R and two coplanar flat fuse terminals of length L and width W projecting axially from opposite ends of the fuse body, in which each fuseholder/stab member includes a continuous conductive metal strap comprising, in sequence:

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

20. An assembly system for fusible pull out switches according to claim 13, for use with fuses of the kind including a cylindrical fuse body of radius R and two coplanar flat fuse terminals of length L and width W projecting axially from opposite ends of the fuse body, in which each fuseholder/stab member includes a continuous conductive metal strap comprising, in sequence:

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

21. An N-pole fusible pull out switch comprising:

an insulator base including N line terminal mounts aligned one for one with N load terminal mounts, with the line terminal mounts at one end of the base and the load terminal mounts at the opposite end of the base;

2N essentially identical conductive terminals each mounted on a terminal mount in the base;

N conductive line contacts each mounted on a line terminal;

N conductive load contacts each mounted on a load terminal, the load contacts constituting flopovers of the line contacts;

insulator barrier means mounted on and comprising a cover for the base, the barrier means having 2N spaced connect apertures individually aligned with the line and load contacts and 2N similarly spaced disconnect apertures displaced from the connect apertures;

an insulator base extension mounted on the base over the barrier means and defining a head receptacle;

an insulator, including 2N fuseholder/stab mounts, insertable into the base extension head receptacle in a connect orientation or in a disconnect orientation displaced 180° from the connect orientation;

2N conductive fuseholder/stab members, each including a stab for engaging a line or load contact to complete a circuit connection, each fuseholder/stab member mounted on one of the mounts in the head in an alignment corresponding to one pair of connect and disconnect apertures in the barrier means.

22. A fusible pull out switch according to claim 21 in which each terminal comprises an elongated conductive metal strap having at least one tapped terminal mounting hole on its centerline and at least one tapped contact mounting hole displaced from the terminal mounting hole, each terminal being mounted in the base by a screw extending through the base, threaded into the terminal mounting hole and projecting upwardly through the terminal as a contact alignment post, and in which each contact is mounted on a terminal by a screw extending downwardly through a hole in the contact and threaded into a contact mounting hole in the terminal, each contact further having an alignment aperture engaging the alignment post.

23. A fusible pull out switch according to claim 22 in which each terminal comprises two terminal mounting holes and is mounted in a base by two screws each affording a contact alignment post, and in which each contact has two alignment apertures engaging the alignment posts for its terminal.

24. A fusible pull out switches according to claim 23 in which each terminal comprises two contact mounting holes aligned along a line parallel to the terminal centerline and in which each contact is secured to its terminal by only one screw threaded into one of the contact mounting holes.

25. A fusible pull out switch according to claim 23 in which each terminal comprises two contact mounting holes laterally displaced from each other and in which each contact is secured to its terminal by two screws each threaded into one contact mounting hole.

26. A fusible pull out switch according to claim 21 in which the barrier means includes interference elements to prevent mounting that barrier means on a base having line or load contacts mounted in any positions other than the line and load positions matching the connect apertures of that barrier means.

27. A fusible pull out switch according to claim 26 in which the base includes N pairs of open-top terminal compartments with a line terminal mount and a load terminal mount in each compartment pair, and in which the barrier means comprises N essentially identical insulator barriers each covering one pair of terminal compartments, with at least one integral interference element on each barrier, each barrier having two connect apertures and two disconnect apertures.

28. A fusible pull out switch according to claim 27 in which each barrier includes two interference elements to prevent mounting the barrier on a base having contacts in incorrect line or load contact positions and two additional interference elements to prevent mounting the barrier in an incorrect orientation on a base having contacts in correct line and load positions.

29. A fusible pull out switch according to claim 27 in which each barrier is keyed to the base so that the barrier can be mounted in only one orientation over a pair of base terminal compartments.

30. A fusible pull out switch according to claim 21, for use with fuses of the kind including a cylindrical fuse body of radius R and two coplanar flat fuse terminals of length L and width W projecting axially from opposite ends of the fuse body, in which each fuseholder/stab member includes a continuous conductive metal strap comprising, in sequence;

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

31. A fusible pull out switch according to claim 27, for use with fuses of the kind including a cylindrical fuse body of radius R and two coplanar flat fuse terminals of length L and width W projecting axially from opposite ends of the fuse body, in which each fuseholder/stab member includes a continuous conductive metal strap comprising, in sequence:

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

32. A fuseholder/stab member for mounting one end of a fuse in a fusible switch, the fuse including a cylindrical fuse body of radius R and two coplanar flat fuse terminals of length L and width W projecting axially from opposite ends of the fuse body, the fuseholder/stab member including a continuous conductive metal strap comprising, in sequence:

a mounting base portion having a length less than 2R;

a U bend portion of substantial radius with an included angle of the order of 20°;

a flat fuse-mount portion having a length of about W and having a height over the base portion, at the center of the fuse-mount portion, of about R;

and an external stab portion extending away from the fuse-mount portion in a direction approximately perpendicular to the base portion.

33. A fuseholder/stab member for a fusible switch, according to claim 32, in which the fuse-mount portion of the metal strap has a centrally located fuse mounting aperture and further comprises a nut affixed to the fuse-mount portion, on the side thereof facing the base portion, in centered alignment with the fuse mounting aperture.

* * * * *